United States Patent [19]

Kay

[11] Patent Number: 4,773,134

[45] Date of Patent: Sep. 27, 1988

[54] CORRUGATED FIBERBOARD CASKET LID

[75] Inventor: William M. Kay, Boyertown, Pa.

[73] Assignee: Amedco Funeral Supply, Inc., Boyertown, Pa.

[21] Appl. No.: 891,056

[22] Filed: Jul. 31, 1985

Related U.S. Application Data

[63] Continuation of Ser. No. 613,145, May 23, 1984, abandoned.

[51] Int. Cl.[4] ..... B65D 5/28; B31B 1/25; A61G 17/00

[52] U.S. Cl. ..... 27/14; 27/2; 229/114

[58] Field of Search ..... 27/1, 4, 14, 15, 16, 27/17, 18, 19, 20, 2, 3, 35; 206/320; 220/460; 229/DIG. 2, DIG. 4, DIG. 5, 87 R, 114, 113

[56] References Cited

U.S. PATENT DOCUMENTS

| | | | |
|---|---|---|---|
| 678,348 | 7/1901 | Nichols | 27/3 |
| 1,128,865 | 2/1915 | Freeman | 27/35 |
| 1,903,197 | 3/1933 | Scott | 27/3 |
| 1,989,962 | 2/1935 | Zinser et al. | 27/3 |
| 2,111,337 | 3/1938 | Sherman | 27/3 |
| 2,131,182 | 9/1938 | Kells | 27/35 |
| 2,338,035 | 12/1943 | Gerold | 27/14 |
| 2,521,184 | 9/1950 | Paige | 206/45.31 |
| 2,974,390 | 3/1961 | Nelson | 27/7 |
| 3,157,936 | 11/1964 | Hillenbrand | 27/19 |
| 3,220,080 | 11/1965 | Connelly | 27/2 |
| 3,316,608 | 5/1967 | Ross | 27/19 |
| 3,490,114 | 1/1970 | Connelly et al. | 27/2 |
| 4,123,831 | 11/1978 | Covington | 27/2 |
| 4,151,630 | 5/1979 | Havey | 27/2 |
| 4,176,431 | 12/1979 | Havey | 27/2 |

FOREIGN PATENT DOCUMENTS

| | | | |
|---|---|---|---|
| 2402470 | 7/1974 | Fed. Rep. of Germany | 27/4 |
| 2608058 | 9/1977 | Fed. Rep. of Germany | 27/2 |
| 3234715 | 7/1983 | Fed. Rep. of Germany | 27/2 |
| 574332 | 3/1958 | Italy | 220/460 |
| WO82/04186 | 12/1982 | PCT Int'l Appl. | 27/4 |

*Primary Examiner*—Richard J. Johnson
*Attorney, Agent, or Firm*—John T. Synnestvedt; Kenneth P. Synnestvedt

[57] ABSTRACT

A casket lid and method of manufacture is disclosed. The lid is formed by cutting corrugated fiberboard to form a blank having a central section and end sections, the central section being scored on parallel lines extended longitudinally of the lid, and the central section is flexed on the score lines to provide a domed configuration.

6 Claims, 3 Drawing Sheets

CORRUGATED FIBERBOARD CASKET LID

This is a continuation of co-pending application Ser. No. 613,145, filed on May 23, 1984, now abandoned.

BACKGROUND AND STATEMENT OF OBJECTS

This invention relates to caskets or coffins and is particularly concerned with a casket lid formed, at least in part, of corrugated fiberboard sheet material.

The fabrication of caskets and casket lids from corrugated fiberboard is known, but some problems have been encountered in the fabrication of casket lids of domed configuration.

The primary objective of the present invention is to provide a novel technique for the fabrication of a casket lid from corrugated fiberboard, and the invention is particularly concerned with the fabrication of a casket lid which has the domed configuration not only laterally of the lid but also longitudinally thereof.

It is an object of the invention to provide for such fabrication of a domed casket lid from corrugated fiberboard provides a lid structure of substantial strength and igidity, notwithstanding the formation of the lid from corrugated fiberboard.

It is also an object of the invention to provide for the fabrication of a corrugated fiberboard casket lid in a configuration in which transverse bridges or strengthening members are applied to the lid in a manner providing for use of the lid either in a single piece or alternatively as a split lid, i.e., in two pieces. This is accomplished by cutting the originally formed complete lid structure in the central region between transverse strengthening bridge members, thereby providing lid sections, each of which has adequate rigidity and strength.

BRIEF DESCRIPTION OF THE DRAWINGS

How the foregoing and other objects and advantages are attained will appear more fully from the following description referring to the accompanying drawings, in which.

Figure 5:
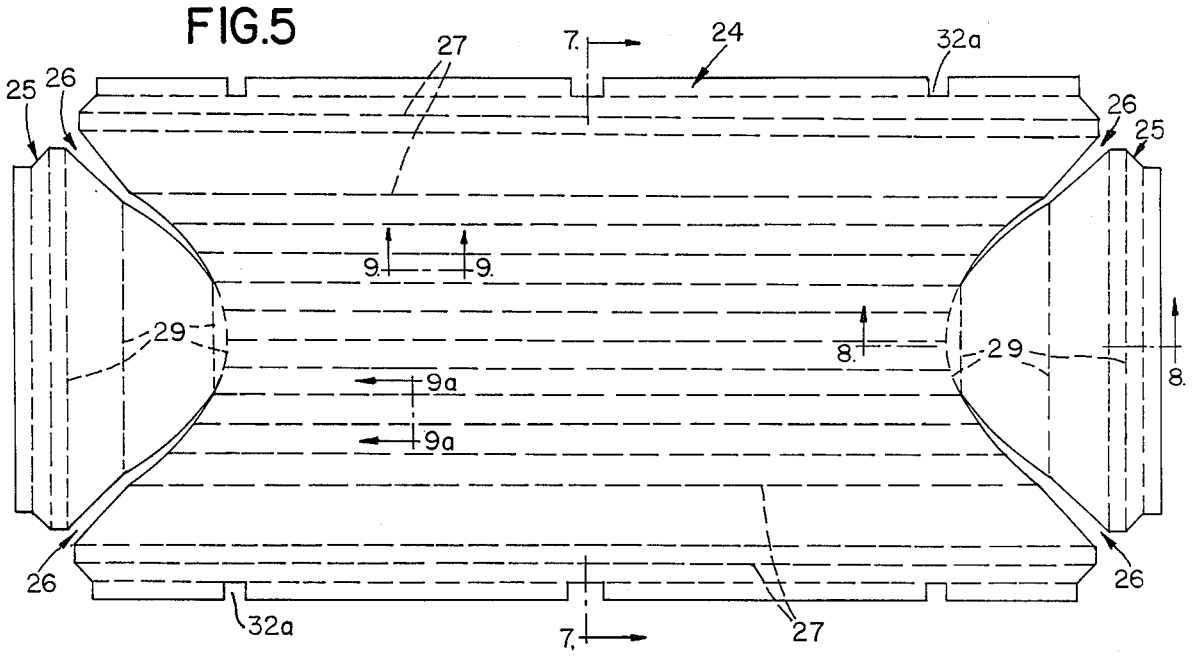
FIG. 5 is a plan view of a cut blank prepared for formation of a lid according to the present invention.
Figure 6:
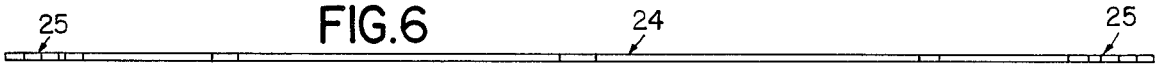
FIG. 6 is an edge view of the blank shown in FIG. 5.
Figure 7:
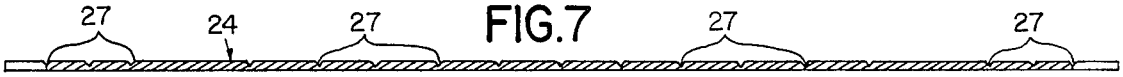
FIG. 7 is an enlarged transverse sectional view taken as indicated by the section line 7—7 on FIG. 5.
Figure 10:
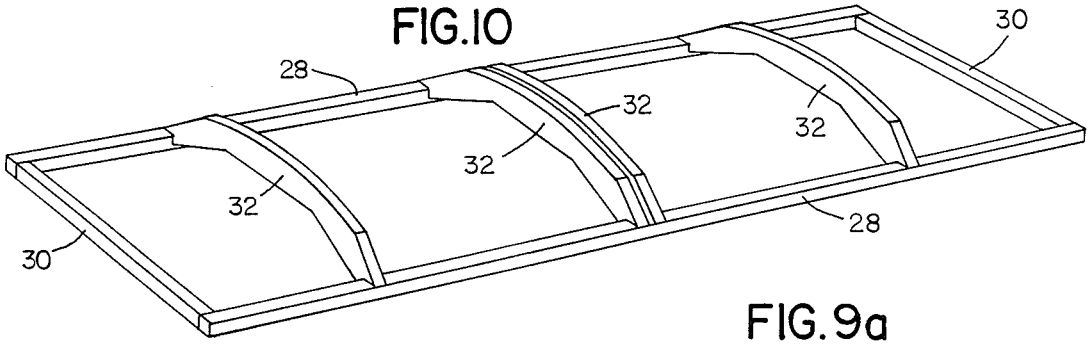
Figure 11:
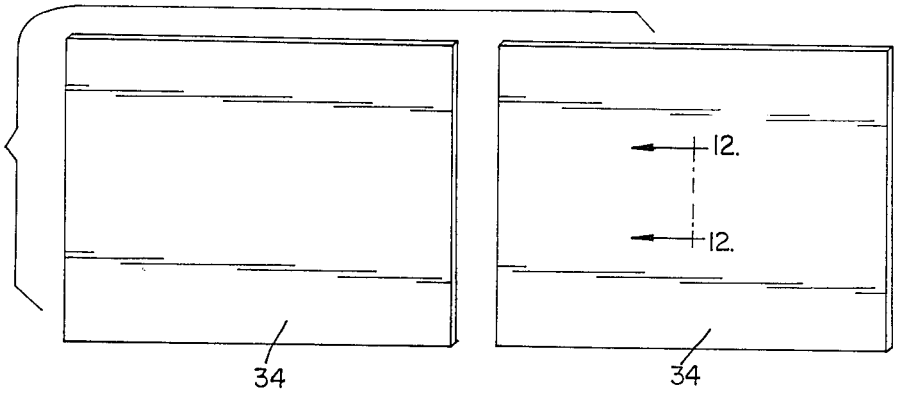
Figure 13:
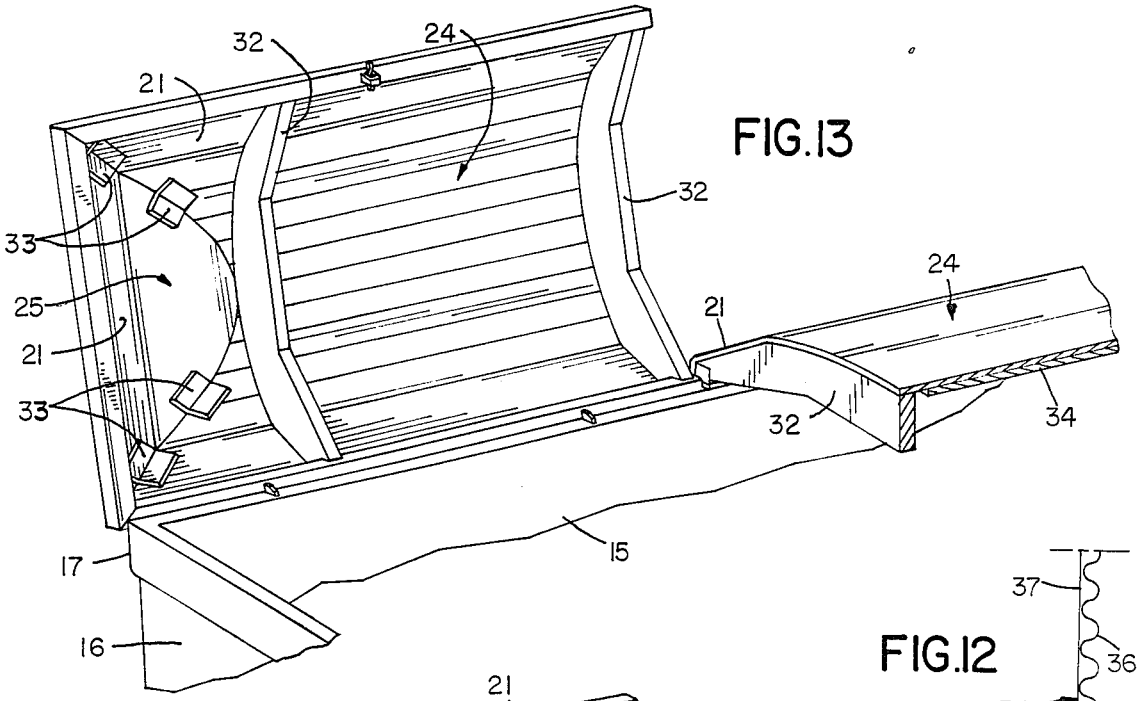
Figure 12:
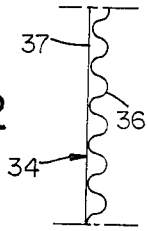
Figure 14:
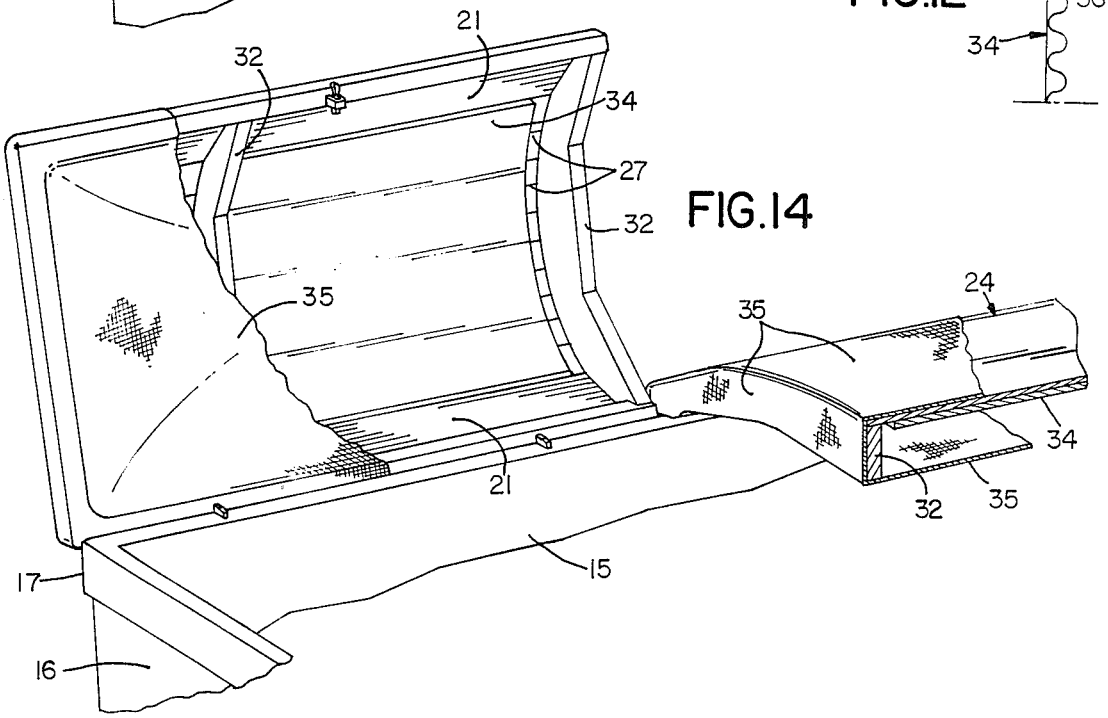

FIG. **9*a* is an enlarged fragmentary transverse sectional view taken as indicated by the section line *9a—9a* on FIG. 5**;

FIG. 10 is a view illustrating an assembly of the marginal framing and the transverse bridges employed in forming the lid of the present invention;

FIG. 11 is a plan view of liner inserts adapted to be applied to the underside of portions of the lid of the present invention;

FIG. 12 is an enlarged fragmentary transverse sectional view through one of the liner inserts shown in FIG. 11, taken as indicated by the section line 12—12 on FIG. 11;

FIG. 13 is a fragmentary view of a casket shell with one portion of a sectionalized lid according to the invention applied thereto, but without the liner inserts; and FIG. 14 is a view conforming with FIG. 13 but in which a liner insert has been applied, and further in which a portion of a fabric covering is fragmentarily indicated.

DETAILED DESCRIPTION OF THE DRAWINGS

In considering various figures of the drawings, it should be kept in mind that the lid of the present invention is suitable for use with a wide variety of casket shells. In a typical case, it is contemplated that the casket lid of the invention will be applied to a casket shell similarly formed of corrugated fiberboard. The shell shown in FIGS. 1, 3, 4, 13 and 14 has an upwardly flared configuration between the side walls 15 and also between the end walls 16. In a typical case, the shell is provided with a wood frame at its upper edge, as indicated at 17, the frame 17. Appropriate handles or other hardware may also be provided on the shell, such as indicated at 18, in any desired manner.

Although it is contemplated that the lid of the present invention be used with a shell which is similarly formed of corrugated fiberboard sheet material, the figures of the drawings do not illustrate the details of the corrugated fiberboard shell, since that structure forms no part of the present invention per se.

From FIGS. 1, 2, 3 and 4, it will be seen that the lid is of domed configuration both longitudinally and transversely of the lid and of the casket. The central portion 19 of the lid is transversely domed and the end portions 20 are longitudinally domed. Preferably also, the central and end domed portions of the lid are surrounded by a beveled edge part indicated at 21, this beveled edge part being extended all the way around the lid, as will be clear from examination of FIGS. 1 to 4. In FIGS. 1 to 4, the corrugated character of the fiberboard is not illustrated; but from other figures described hereinafter, it will be understood that the main sheet elements of the lid are formed of corrugated fiberboard.

Figure 9:
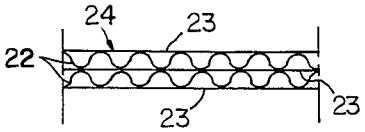
FIG. 9 is an enlarged fragmentary longitudinal sectional view taken as indicated by the section line 9—9 on FIG. 5.
Figure 8:
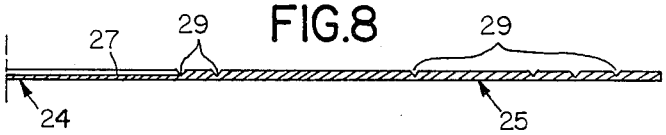
FIG. 8 is a fragmentary sectional view of the blank taken as indicated by the section line 8—8 on FIG. 5.

In the fabrication of a lid according to this invention, a blank is cut from corrugated fiberboard sheet material, preferably multiple corrugated fiberboard, for instance, fiberboard having two corrugated layers, as indicated at 22 in FIG. 9, these layers being assembled with three planar sheets indicated at 23. As will be noted from FIG. 9, the corrugations run transversely of the length of the lid. As seen in FIG. 5, the corrugated sheet material is cut to form a blank of overall general dimensions corresponding to the length and the width of the casket lid being formed. The blank has a central section or area generally indicated at 24 corresponding to the principal portion of the central region of the casket lid; and the blank also includes end portions or sections 25 corresponding to the end portions of the lid. These various areas are defined in part by the cutting of generally diagonal cut-outs indicated a 26.

Figure 9A:
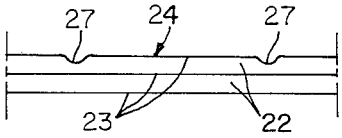

The central area 24 is then provided with score lines indicated at 27 (see also FIG. 9*a*). These score lines facilitate and provide for uniformity of flexure of the blank in the central region in order to provide the transversely domed configuration of the lid. The marginal score lines at the opposite sides of the central region also provide for folding of the edges of the lid around the side frame members 28 (see particularly FIGS. 3 and 10). The score lines also aid in defining the edges of the beveled edge areas 21.

Figure 3:
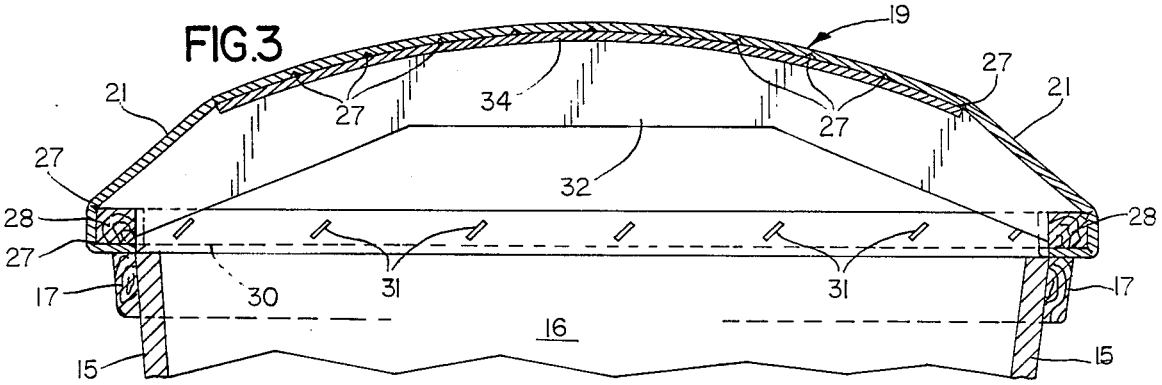
FIG. 3 is an enlarged transverse sectional view taken as indicated by the section line 3—3 on FIG. 2.
Figure 4:
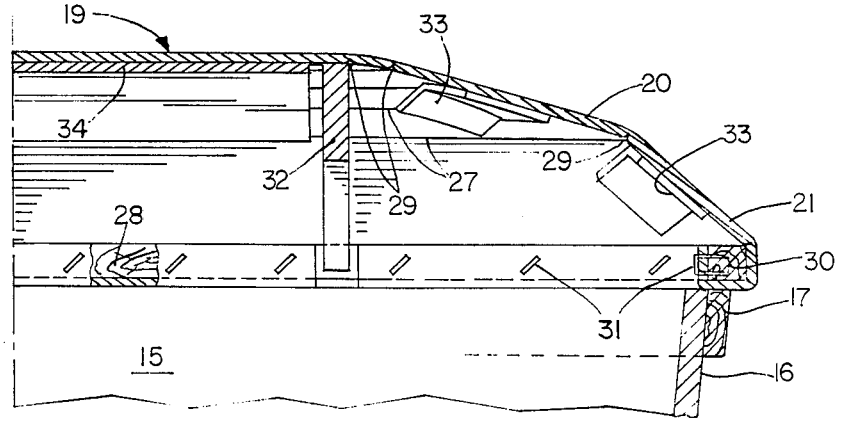
FIG. 4 is a fragmentary longitudinal sectional view taken as indicated by the section line 4—4 on FIG. 2.

The end areas 25 of the blank are also provided with certain score lines 29, as will be seen in FIG. 5, and those score lines similarly aid in defining the beveled edges in the end portions of the lid and also provide for folding of the edges around the frame elements 30 (see FIGS. 4 and 10). Preferably, the frame elements 28 and 30 are formed of wood, and as seen in FIGS. 3 and 4, the terminal edge portions of the blank may be fastened to the frame elements 28 and 30 as by stapling indicated at 31.

Transverse marginal bridges are also applied inside of the lid, these bridges being indicated at 32 in FIGS. 2, 3, 4, 10, 13 and 14. These bridges are also preferably formed of corrugated fiberboard and may comprise material similar to that illustrated in FIG. 9, but preferably, the bridges comprise a greater number of layers of the corrugated and planar sheets, for instance, four corrugated layers, with intervening planar sheets. If desired, the bridges may be formed by laminating two corrugated sheets of the kind shown in FIG. 9 to each other and then cutting the bridges from that laminated assembly. By this use of multiple-layered corrugated material, the bridges will provide a very high degree of strength and rigidity.

The edges of the blank are desirably notched, as indicated at 32*a*, to accommodate the bridges when the edges of the blank are folded around the frame elements 28.

Figure 2:
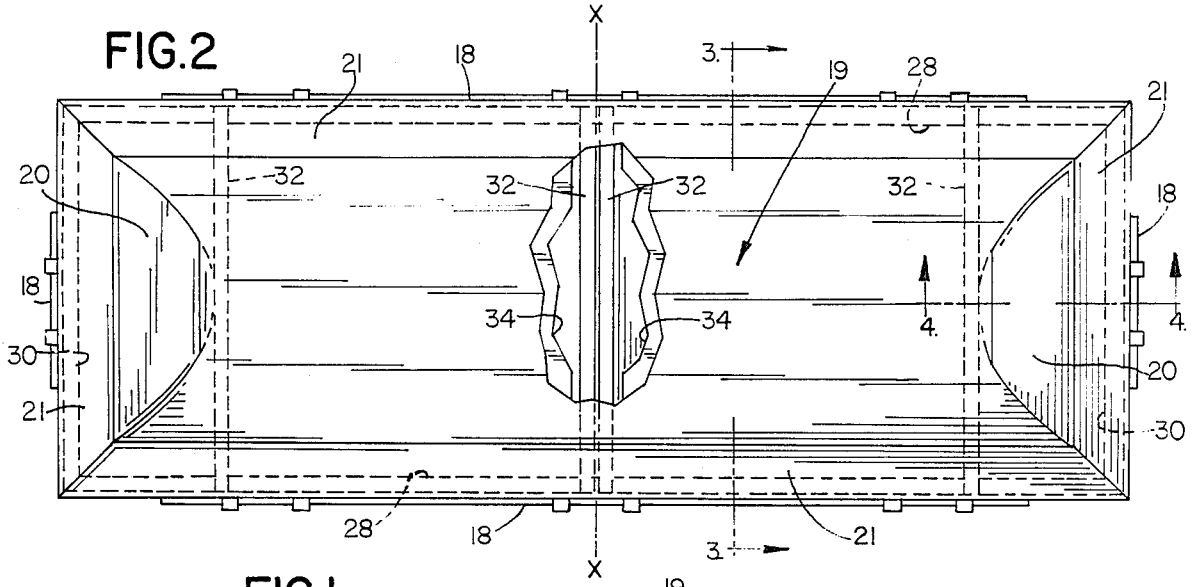
FIG. 2 is a top plan view of the lid as applied to the casket shown in FIG. 1
Figure 1:
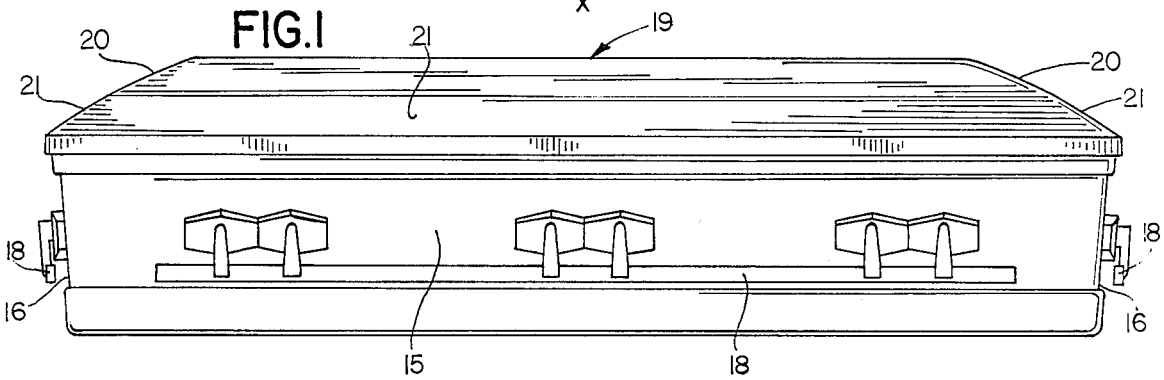
FIG. 1 is a side elevational view of a lid conforming with the present invention and applied to a casket shell.

It will further be observed that in the embodiment illustrated, a bridge 32 is positioned adjacent to the junction between each end section of the lid and the central section thereof, and in addition to these two end bridges, a pair of bridges 32 are located in the central region of the central area of the lid, as clearly appears in FIG. 2. Slight spacing between these two central bridges along the line indicated at x—x in FIG. 2 provides freedom for cutting the formed lid into two sections, so that the lid may alternatively be used in sectionalized form, instead of as a single unit. Such a sectionalized portion of the lid is shown in FIGS. 13 and 14.

As above indicated, in addition to the transversely domed configuration of the central portion of the lid, the end portions may also be curved to domed shape, the cutouts 26 being configured and positioned so as to accommodate this longitudinal domed configuration and provide a meeting line joining the edge portions of the central region. When the central region and the end portions are flexed to the domed configuration desired, fiberboard "patches" 33 may be adhesively applied to the inside surface of the lid being formed in order to unify the structure of the central section and the end sections.

To further reinforce and strengthen the lid, liner inserts, such as shown in FIGS. 11 and 12, are preferably applied to the lid between the bridges 32. These liner inserts comprise rectangular portions indicated at 34 in FIG. 11 adapted to be flexed and adhesively applied to the central sections at each side of the central bridges 32.

Material appropriate for use as liner inserts is indicated in the enlarged fragmentary sectional view of FIG. 12. Thus, it will be seen that a single corrugated layer 36 and a single flat sheet 37 are preferably employed, the planar sheet 37 being presented inwardly and the corrugated layer being adhesively applied to the under surface of the lid. The corrugations of the corrugated layer 36 of the inserts 34 desirably extend lengthwise of the lid in order to avoid wrinkling when the inserts are flexed to fit the contour of the lid.

It will be understood that appropriate hinges and latches may be appled in order to connect the frame of the casket lid to the frame of the casket shell.

It is also contemplated that the interior of both the shell and the lid may be covered with appropriate fabric, and in the arrangement of the lid, such fabric strips may readily be applied over the entire inner surface of the lid, covering not only the main central and end areas but also covering the transverse bridges. A portion of such a fabric covering is indicated fragmentarily at 35 in FIG. 14.

According to the foregoing, a casket lid is provided having domed configuration not only transversely but also longitudinally, and this is accomplished in a relatively simple manner from relatively inexpensive materials, while at the same time, providing substantial rigidity and strength.

I claim:

1. A method for making a casket lid having bevelled edge portions and a generally domed configuration between the bevelled edges both laterally and longitudinally of the lid, which method comprises cutting a preformed corrugated board to form a generally rectangular blank of overall dimensions approximating the length and width of the lid, said board comprising preformed corrugated fiberboard incorporating at least one corrugated sheet between at least two uncorrugated sheets, forming generally diagonal cut-outs in the corners of said blank to partially separate the end sections of the blank from the central section thereof, scoring the cut blank on a multiplicity of lines extended longitudinally of the lid in the area between the portions to be incorporated in the bevelled side edges and extended lengthwise of the blank between said cut-outs, further scoring the cut blank along lines parallel to the length of the lid in positions to accommodate the formation of the bevelled side edges, scoring the end sections of the blank along lines transverse to the length of the lid in position to accommodate the formation of the bevelled end edges, flexing the edge portions of the blank to form the bevelled edges around the margin of the lid, flexing the central section of the blank on said score lines between the bevelled edge portions to provide progressive increase in the height of the lid in a multiplicity of stages as the central region is approached and thereby provide the laterally domed configuration of the lid, flexing the end sections of the blank to provide for closure of the diagonal cut-outs in the corners of the blank, securing transverse bridge members to the lid, at least one of which is secured to the lid in the mid-region of the laterally domed contour portion thereof, and one of which is secured to the lid toward each end of the lid in the region of the longitudinally domed end portions thereof, and securing framing elements to at least some edges of the lid.

2. A method as defined in claim 1 in which the flexing of the end sections of the lid between the diagonal cut-outs is effected to provide the bevelled end edges of the lid and to provide an upward but reduced inclination of the end section areas inboard of the bevelled end edges.

3. A method for making a casket lid having bevelled edge portions at both the side and end edges of the lid and a domed configuration between the bevelled edges both laterally and longitudinally of the lid, which method comprises cutting a preformed corrugated board to form a generally rectangular blank of overall dimensions approximating the length and width of the lid, said board comprising preformed corrugated fiberboard incorporating at least one corrugated sheet between at least two uncorrugated sheets, forming generally diagonal cut-outs in the corners of said blank to partially separate the end sections of the blank from the central section thereof in the region forming both the bevelled edges and domed portions of the lid, scoring the cut blank along lines extended longitudinally of the lid in positions to accommodate the formation of the bevelled side edges, scoring the end sections of the blank along lines transverse to the length of the lid in position to accommodate the formation of the bevelled end edges, flexing the edge portions of the blank along said scoring lines to form the bevelled edge around the margin of the lid, flexing the centnral section of the blank in the region between said bevelled edges to provide progressive increase in the height of the lid in the region between said bevelled edges as the central region is approached and thereby provide the laterally domed configuration of the lid between said bevelled edges, flexing the end sections of the blank to provide for closure of the diagonal cut-outs in the corners of the blank, and securing framing elements to at least some edges of the lid.

4. A method as defined in claim 3 in which the flexing of the end sections of the lid between the diagonal cut-outs is effected to provide the bevelled end edges of the lid and to provide an upward but reduced inclination of the end section areas inboard of the bevelled end edges.

5. A method for making a casket lid having bevelled edge portions at both the side and end edges of the lid and a domed configuration between the bevelled edges both laterally and longitudinally of the lid, which method comprises:

(a) preparing a generally rectangular blank, the blank being formed of preformed corrugated fiberboard incorporating at least one corrugated sheet between at least two uncorrugated sheets, the preparation of the blank including:

(a1) cutting the blank with overall dimensions approximating the length and width of the lid and with generally diagonal cut-outs in the corners of said blank to partially separate the end sections of the blank from the central section thereof in regions providing for forming both lateral and longitudinal bevelled edges and for forming a central region which is domed both laterally and longitudinally; and (a2) scoring the corrugated fiberboard along lines extended longitudinally of the lid in positions to accommodate the formation of the bevelled side edges and along lines transverse to the length of the lid in positions to accommodate the formation of the bevelled end edges;

(b) flexing the side and end edge portions of the blank along said scoring lines to form the bevelled edges around the margin of the lid and to form the central section of the blank in the region within said bevelled edges to provide progressive increase in the height of the lid in the region within said bevelled edges as the central region is approached both laterally and longitudinally of the lid and thereby provide both the lateral and the longitudinal domed configuration of the lid within said bevelled edges, said flexing further providing for closure of the diagonal cutouts in the corners of the blank and for bringing together said bevelled side and end edges around the perimeter of the lid and also bringing together the laterally and longitudinally domed portions of the lid; and (c) securing framing elements to at least some edges of the lid.

6. A top for a casket, said top being of corrugated paperboard of substantial stiffness and comprising:

spaced, parallel side walls, spaced, parallel end walls, an arched panel having a crest and sides extending substantially parallel to said side walls and having a length less than said side walls, means comprising fold lines joining said arched panel to said side walls, said arched panel having at least four parallel score lines extending lengthwise of said arched panel and spaced from side-to-side thereof and being sufficiently closely spaced to closely approximate an arched shape, all of the panels of said top being folded only in the same direction whereby the exterior angle between all adjacent panels is greater than 180°, means for connecting said arched panel to a said end wall comprising an inclined panel longitudinal of said arched panel and connected thereto by an arcuate fold line, said acuate fold line extending laterally outwardly of the crest of said arched panel and terminating inwardly of the sides of said arched panel, said arched panel and said inclined panel having curved edges laterally outwardly of the ends of said arcuate fold line, said curved edges being in mating abutting relationship to provide arched corners between said inclined panel and said arched panel, ribs extending transversely of and underlying said arched panel, said ribs each having an outer surface substantially conforming to the inner surface of said arched panel and side walls, said side walls comprising means for increasing the thickness thereof relative to said arched panel, means for connecting said ribs to said side walls, said arched panel, inclined panel, and panels of said end walls and side walls being parts of a single cut and scored blank of corrugated paperboard.

* * * * *

UNITED STATES PATENT AND TRADEMARK OFFICE
CERTIFICATE OF CORRECTION

PATENT NO. : 4,773,134

DATED : September 27, 1988

INVENTOR(S) : William M. Kay

It is certified that error appears in the above—identified patent and that said Letters Patent is hereby corrected as shown below:

Col. 1, line 24, after "board" and before "provides" insert --by a technique which is readily carried out and which also--.

Col. 1, line 26, change "igidity" to --rigidity--.

Col. 2, line 30, after "cated at 17," and before "the frame 17." insert --and the lid is adapted to be mounted upon and fastened to-- before "the frame 17."

Col. 2, last line, change "a 26." to --at 26.--.

Col. 4, line 14, change "appled" to read --applied--.

Col. 5, claim 3, line 27, change "centnral" to --central--.

Col. 6, claim 6, line 44, change "acuate" to --arcuate--.

Signed and Sealed this

Twenty-eighth Day of March, 1989

*Attest:*

*Attesting Officer*

DONALD J. QUIGG

*Commissioner of Patents and Trademarks*